US007887105B2

(12) United States Patent
Anastasiadis et al.

(10) Patent No.: US 7,887,105 B2
(45) Date of Patent: Feb. 15, 2011

(54) WINDOW LOCK

(75) Inventors: Frankie Anastasiadis, 108 Citation Drive, North York, Ontarion (CA) M2K 1T2; Daniel Vernon Cornwell, Oshawa (CA)

(73) Assignee: Frankie Anastasiadis, North York (CA)

( * ) Notice: Subject to any disclaimer, the term of this patent is extended or adjusted under 35 U.S.C. 154(b) by 118 days.

(21) Appl. No.: 11/951,511

(22) Filed: Dec. 6, 2007

(65) Prior Publication Data

US 2008/0134733 A1 Jun. 12, 2008

Related U.S. Application Data

(60) Provisional application No. 60/868,829, filed on Dec. 6, 2006.

(51) Int. Cl.
*E05C 19/00* (2006.01)
*B65D 45/30* (2006.01)

(52) U.S. Cl. ..... 292/1; 292/DIG. 20; 292/DIG. 49; 411/340

(58) Field of Classification Search ..... 292/1, 292/137, 163, 164, 168, 288, 300–302, DIG. 20 X, 292/DIG. 35, DIG. 44, DIG. 47; 411/340, 411/338, 344–346
See application file for complete search history.

(56) References Cited

U.S. PATENT DOCUMENTS

| | | | | | |
|---|---|---|---|---|---|
| 325,221 | A | * | 8/1885 | Wright | 411/342 |
| 581,693 | A | * | 5/1897 | Capen | 24/610 |
| 1,236,618 | A | * | 8/1917 | Stagman | 292/57 |
| 1,396,279 | A | * | 11/1921 | Paine et al. | 411/346 |
| 1,741,252 | A | | 12/1929 | Shapiro | |
| 1,963,514 | A | * | 6/1934 | Wherren | 249/42 |
| 2,411,485 | A | | 11/1946 | Webster | |
| 3,279,302 | A | * | 10/1966 | Modrey | 411/350 |
| 3,288,510 | A | * | 11/1966 | Gough et al. | 292/251 |
| 3,476,007 | A | * | 11/1969 | Collister | 411/345 |
| 3,642,315 | A | * | 2/1972 | Alpern | 292/144 |
| 3,673,910 | A | * | 7/1972 | Collister | 411/345 |
| 3,861,267 | A | * | 1/1975 | Collister | 411/345 |
| 4,068,506 | A | * | 1/1978 | Phelps | 70/100 |
| 4,293,154 | A | * | 10/1981 | Cassells | 292/144 |
| 4,508,479 | A | * | 4/1985 | Mez | 411/340 |
| 4,822,197 | A | | 4/1989 | DeMartino et al. | |
| 6,421,960 | B1 | * | 7/2002 | Manzella | 49/192 |
| 6,837,004 | B2 | | 1/2005 | Annes | |
| 6,889,480 | B2 | * | 5/2005 | Guhl et al. | 52/786.1 |

* cited by examiner

*Primary Examiner*—Carlos Lugo
*Assistant Examiner*—Mark Williams
(74) *Attorney, Agent, or Firm*—Bereskin & Parr LLP/S.E.N.C.R.L., s.r.l.

(57) ABSTRACT

A lock has a body for extending through the sash and frame of a closed window. A head attached to a first end of the body bears on the outside of the sash. A movable abutment attached to a second end of the body may be positioned (a) so as to bear against the inside of the frame when the window is latched or locked or (b) so as to be able to pass through a hole in the frame to allow the window to be opened. Optionally, the body may have a variable length. Optionally, a plug or seal may be provided in the frame to close a hole in the frame when the window is open. Optionally, the abutment may slide and rotate on a pin in a slot at the second end of the body. Optionally, the abutment may slide and rotate on a pin in a slot at the second end of the body. Optionally, a spring may be provided over the body which, in an extended position, extends across a portion of the abutment.

8 Claims, 4 Drawing Sheets

WINDOW LOCK

This application claims the benefit under 35 USC 119(e) of U.S. application Ser. No. 60/868,829 filed on Dec. 6, 2006.

FIELD

This specification relates to locks or latches for windows.

BACKGROUND

The following discussion is not an admission that anything discussed below is prior art or part of the knowledge of persons skilled in the art.

Some windows, such as casement and awning windows, open by rotating about a pivot or hinge. These windows may be latched closed, for example, by mechanisms as shown in U.S. Pat. Nos. 6,421,960 or 6,837,004. However, particularly with vinyl windows, a burglar may open such a window by inserting a tool between the sash and frame of the window and bending the sash until the latch releases.

SUMMARY

The following summary is intended to introduce the reader to this specification but not to define or limit any claims.

A lock has a body for extending through the sash and frame of a closed window. A head attached to a first end of the body bears on the outside of the sash. A movable abutment attached to a second end of the body may be positioned (a) so as to bear against the inside of the frame when the window is latched or locked or (b) so as to be able to pass through a hole in the frame to allow the window to be opened. Optionally, the body may have a variable length. Optionally, a plug or seal may be provided in the frame to close a hole in the frame when the window is open. Optionally, the abutment may slide and rotate on a pin in a slot at the second end of the body. Optionally, the abutment may slide and rotate on a pin in a slot at the second end of the body. Optionally, a spring may be provided over the body which, in an extended position, extends across a portion of the abutment.

DETAILED DESCRIPTION

Various apparatuses or processes will be described below to provide an example of an embodiment of each claimed invention. No embodiment described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention. The applicants, inventors or owners reserve all rights that they may have in any invention disclosed in an apparatus or process described below that is not claimed in this document, for example the right to claim such an invention in a continuing application and do not intend to abandon, disclaim or dedicate to the public any such invention by its disclosure in this document.

U.S. Pat. Nos. 325,221; 1,741,252; 2,411,485; 3,673,910; 4,508,497; and, 4,822,197 describe a quick connect/disconnect fastener assemblies that include a head, a bifurcated stem or post having a secondary or locking means slidably and swingably related thereto for movements between locked and unlocked positions. U.S. Pat. Nos. 325,221; 1,741,252; 2,411,485; 3,673,910; 4,508,497; and, 4,822,197 are incorporated herein in their entirety by this reference to them.

Figure 2:
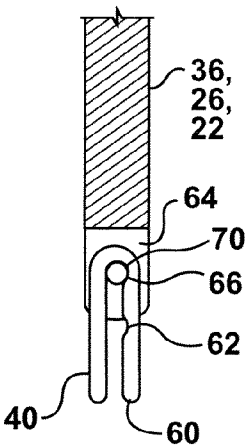
FIG. 2 is a cross-section of a portion of the lock of FIG. 1 in an unlocked position.
Figure 1:
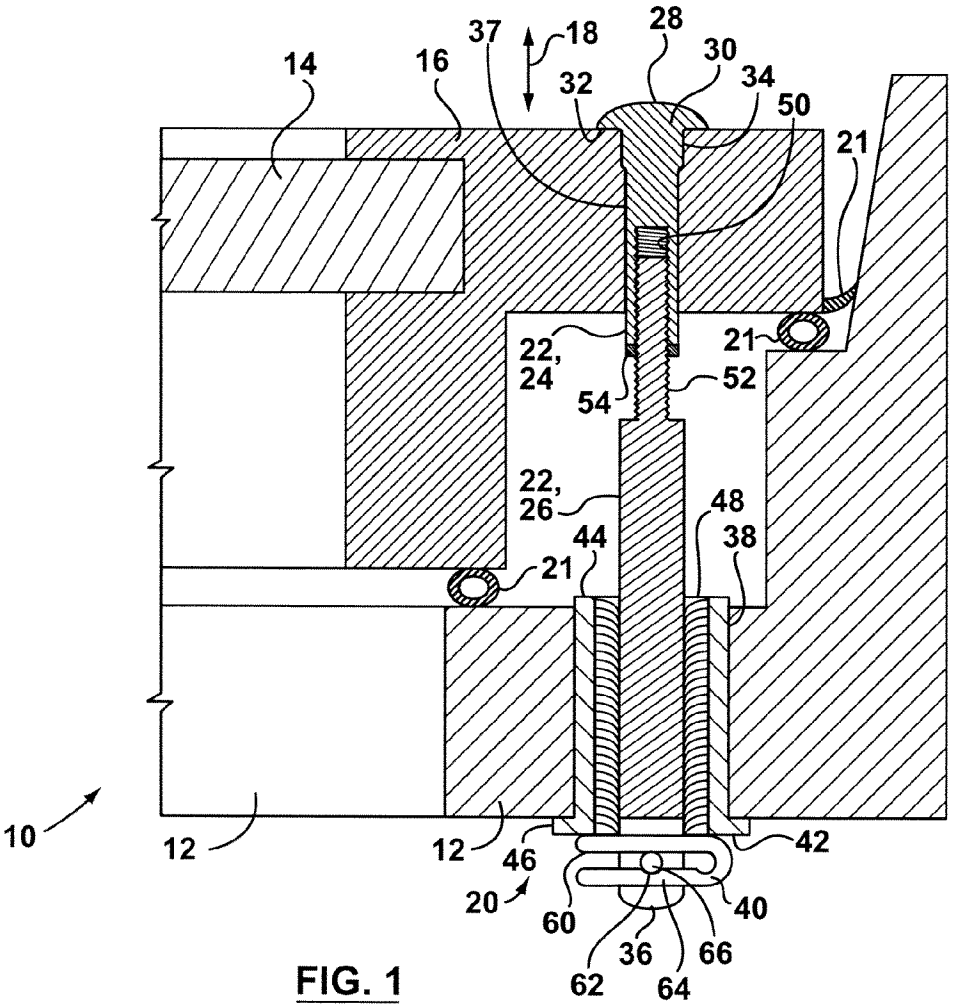
FIG. 1 is a cross-section of a portion of a window having a lock in a locked position.

Referring to FIGS. 1 and 2, a window 10 has a frame 12 and one or more panes of glass 14, for example a sealed unit, held in a sash 16. Sash 16 is attached to frame 12 through a hinge or pivot located on the far side of frame 12 and not visible in FIG. 1. Sash 16 opens and closes through movements in the direction of arrows 18. Window 10 may be, for example, a casement or awning window. Seals 21 are compressed between sash 21 and frame 12 when sash 21 is closed. Window 10 may, or may not, have conventional locks or latches to hold sash 16 closed. The pieces making up the frame 12 and sash 16 may have various cross-sections other than shown and may be made of various materials. Sash 16 and frame 12 may be made of vinyl in which case they may be extended and generally hollow but with various internal ribs or webs.

A lock 20 has a body 22 which optionally includes a first part 24 and a second part 24. Body 22 extends through the sash 16 and frame 12. A head 28 at a first end 30 of body 22 has edges 32 which extend beyond body 22 and bear against the outside of sash 16. Below the head 28, a portion of the body 22 passing through the sash 16 may be a smooth or threaded cylinder.

A below head portion 34 may have a cross-section that is non-circular, for example square or hexagonal, to make it more difficult to rotate the body 22 by the head 28. The head 28 may also have a shape, such as a shallow dome, that is difficult to grip with tools for the same purpose. The body 22 may be press-fit or screwed into a hole 37 drilled, punched or otherwise provided in the sash 16. When the sash 16 is closed, a second end 36 of the body 22 passes through a clearance hole 38 drilled, punched or otherwise provided in the frame 12. When the sash 16 is opened, the second end 36 of the body 22 passes outwards through the clearance hole 38. When the lock 20 is engaged, a movable abutment 40 attached to the second end 36 of the body 22 bears, directly or indirectly, against the inside of the frame 12 to prevent the body 22 from passing through the clearance hole 38 and thereby preventing the sash 16 from being opened. The lock 20 may be retrofit to a window already installed, or built into a new window before installation.

The clearance hole 38 may be fitted with an optional plug 42. The plug 42 may have a shaft 44 pressed or threaded into the clearance hole 38 and a flange 46 bearing against the inside of the frame 12. Flange 46 may help distribute forces from the abutment 40 of the lock 20 to the inside of the frame 12 if someone or the wind tries to force the sash 16 open. Shaft 44 may include a movable seal 48. For example, a seal made of fibers attached to the inside of shaft 44 is shown. Seal 48 closes some or all of the passage through the clearance hole 38 when the body 22 is removed to inhibit insect or water entry through the clearance hole 38 when the sash 16 is open, or when the sash 16 is closed if no other seal 20 is located between the clearance hole 38 and the periphery of the frame 12.

A large percentage of windows are made within a few millimeters of a small set of distances from the outside of the sash 16 to the inside of the frame 12. Accordingly, a body 22 made in one piece or otherwise with a fixed length may be useful even when used to retrofit installed windows 10. However, body 12 may also be made to have an adjustable length. For example, the body 22 shown has a threaded bore 50 inside of first part 24 and a threaded shaft 52 extending from a second part 26. By rotating the threaded shaft 52 in the threaded bore 50, the length of the body 22 may be altered. A lock nut 54 may be tightened against the first part 24 to lock the body 22 at the desired length. Alternatively, the threaded bore 50 may have a plastic or rubber insert to grip the threaded shaft 52, chemical thread locking solutions or solder may be applied, or other means may be used to fix the length of the body 22. Other means of making the length of the body 22 adjustable may also be used. Further alternatively, one or more washers may be placed between the head 28 and the sash 16 or between the abutment 40 and the frame 12 to account for varying window thicknesses. Further alternatively, plugs 42 may be made with flanges 46 of varying thickness or one or more washers may be placed between the flange 46 and the frame 12. If a one piece or non-adjustable length body 22 is used, rotation of the head 28 does not risk lengthening the body 22. In this case, the portion of the body 22 that passes through the sash 16 may be threaded, the below head portion 34 may be round, and the second end 26 of the body 22 may be made small enough to pass through the hole 37 in the sash 16 and used to rotate the body 22 to screw it into the hole 37. A small space between the abutment 40 and the frame 12 when the sash 16 is closed, for example up to 3 mm, is acceptable if the window 10 has other locks or latches that compress the seals 20. At least one of first part 24 and second part 26 may be made of a non-metallic material, for example polycarbonate or another plastic, to provide a thermal break in the body 22.

The abutment 40 in the lock 20 of FIG. 1 is cut from a plate of generally stiff but elastic material such as steel or plastic. Part of the abutment 40 is located within a slot 64 in the second end 36 of the body 22. The thickness of the abutment 40 may be slightly greater than the thickness of the slot 64 such that, while the abutment 40 may slide and rotate in the slot 64 there is some frictional resistance to these motions and the abutment 40 tends to stay where it is placed until moved again. In this way, when the abutment 40 is located to allow the body 22 to pass in or out through the clearance hole 38, the abutment 40 is unlikely to move accidentally to a position that binds in the clearance hole 38.

Figure 7:
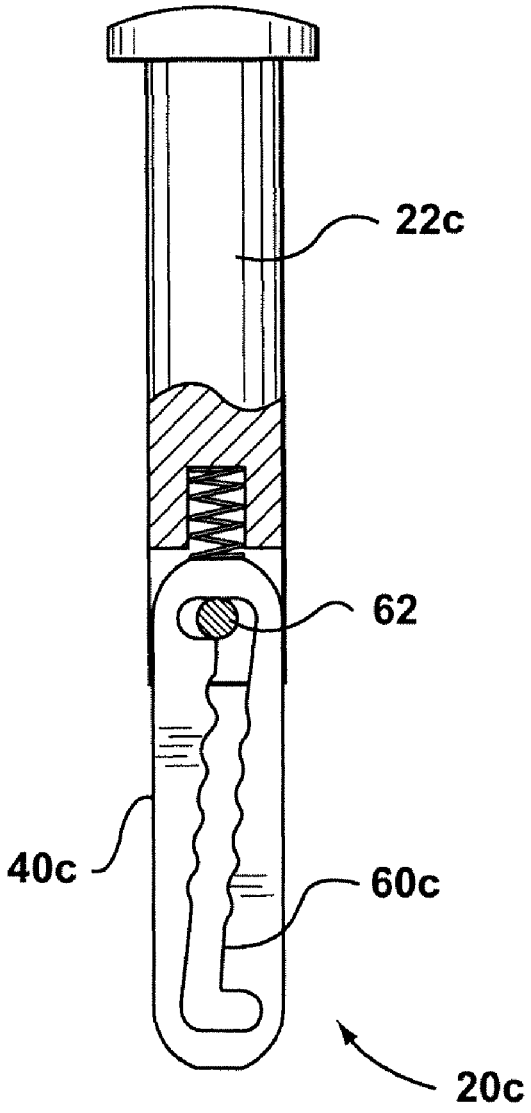
FIG. 7 shows another lock with the body partially sectioned.
Figure 8:
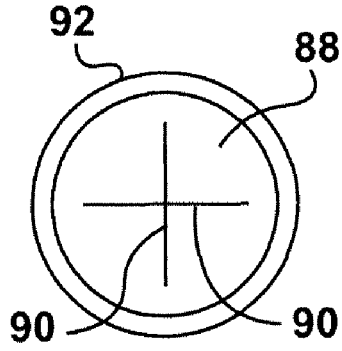
FIG. 8 shows a cover for a clearance hole.

The abutment 40 has a slot 60 with a detent 62. A pin 66 in the slot 64 of the body 22 is slightly wider than the slot 60 of the abutment 40 except at the detent 62 and at a slot end 70. In this way, the abutment 40 resists movement from the locked position shown in FIG. 1 but the slot 60 of the abutment 40 is not forced open while in an unlocked position shown in FIG. 2. The width of the abutment 40 is smaller that the diameter of clearance hole 38 or the inside diameter of plug 42 such that, when the abutment 40 is slid to the left and rotated downwards from the position shown in FIG. 1, the abutment 40 no longer prevents the body 22 from being removed from the frame 12. For example, the abutment 40 may be about as wide as the diameter (or maximum distance across the cross-section if not circular) of the part of the body 22 that passes through the frame 12. The abutment 40 and the second end 36 of the body 22 may be as described in any of U.S. Pat. Nos. 325,221; 1,741,252; 2,411,485; 3,673,910; 4,508,497; and, 4,822,197. With either a single piece or adjustable length body 22, an abutment may be used that has, in the locked position, a variable dimension between the pin 66 and head 28 as shown for example in a third lock 20*c* shown in FIG. 7. Using a third abutment 40*c* of FIG. 7 to replace abutment 40 may help account for variations in the thickness of a sash 16 or frame 12 or allow the third abutment 40*c* to press against the inside of frame 12 or compress the seals 21 by varying the location of the pin 62 in a third slot 60*c* of third abutment 40*c* of FIG. 7.

Figure 3:
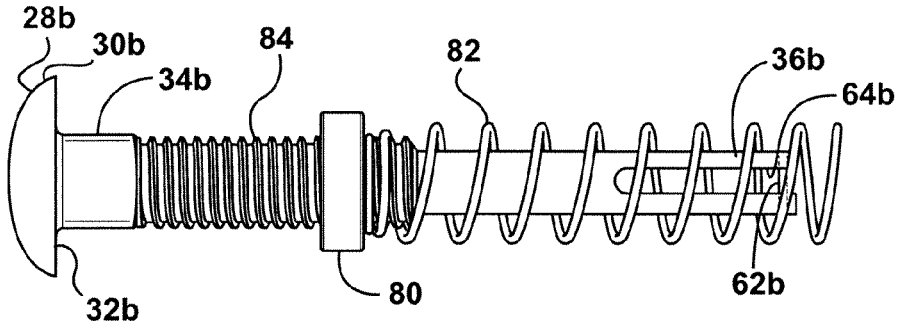
FIG. 3 shows a body of another lock.
Figure 4:
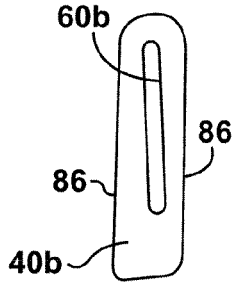
FIG. 4 shows an abutment for use with the lock of FIG. 3.
Figure 5:
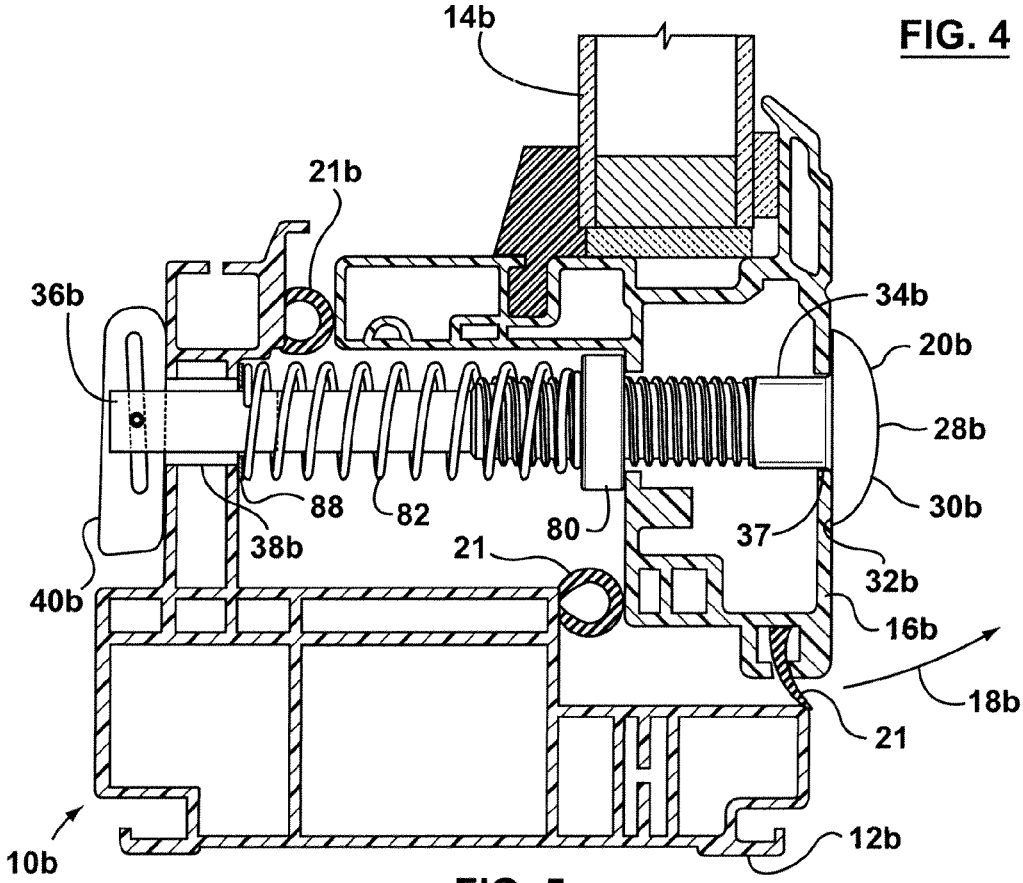
FIG. 5 shows the lock of FIGS. 3 and 4 installed in a window in a locked position.

FIGS. 3, 4 and 5 show a second lock 20*b*. Components of second lock 20*b* that are similar to components of lock 20 of FIGS. 1 and 2 have been given the same reference numeral followed by a "b". For those elements of second lock 20*b*, the description for the first lock 20 applies except where inconsistent with text or Figures describing the second lock 20*b*.

Figure 6:
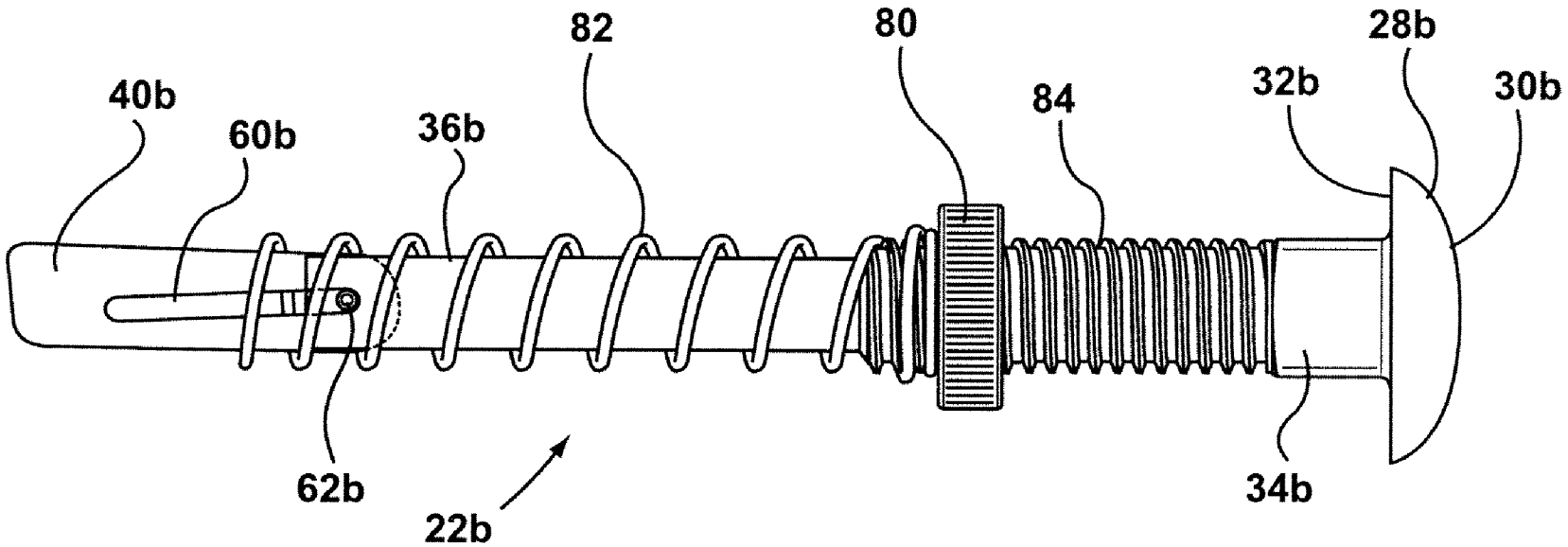
FIG. 6 shows the lock of FIGS. 3 and 4 assembled with a spring in an extended position.

A second body 22*b* of second lock 20*b* is a one piece construction made of a metal or plastic, for example brass, steel or a polycarbonate. A nut 80 or a threaded portion 84 is used to keep the second body 22*b* in the second sash 16*b*. If the second body 22*b* is metal, at least the second head 28*b* may be powder coated or covered, for example with vinyl, to reduce heat transfer. A spring 82 is placed over a part of the second body 22*b* on the opposite side of the nut 80 from the second head 28*b*. The spring 82 may press at one end against the nut 80 or may be stretched or threaded over a part of the threaded portion 84. In an extended position, the spring 82 extends over part of a second abutment 40*b* when the second abutment 40*b* is positioned generally in line with the second body 22*b*. For example, the spring 82 when extended may extend beyond a second pin 62*b*. In this way, when a second sash 16*b* is open, the second abutment 40*b* remains aligned with the second body 22*b* so that it can be made to pass more easily through a second clearance hole 38*b*. When the second sash 16*b* is closed, the spring 82 is compressed into a compressed position in which it bears against the second frame 12*b*. Optionally, the spring 82 may open to a larger diameter where it goes over the threaded portion 84 so that the spring 82 may be narrower and fit closer over the second part 36*b* of the second body 22*b* as shown in FIG. 6.

A second slot 60*b* is angled relative to bearing surfaces 80 of the second abutment 40*b* so that sliding the second abutment 40*b* will account for small variations in dimensions between the length of the second body 22*b* and the second window 10*b*, or allow the second body 22*b* to be placed under tension. Alternatively, the spring 82 may be omitted and a high-friction, for example rubber, washer placed between the second abutment 40*b* and the inside of second slot 64*b*. This assists in keeping the second abutment 40*b* aligned with the second body 22*b* while the second frame 12*b* is closed but does not itself align the second abutment 40*b* as the spring 82 does.

A cover 88 may be placed over the second clearance hole 38*b* to cover the second clearance hole 38*b* while the second sash 16*b* is open. The cover 38*b* is a thin plastic sheet with slits 90 to allow the second lock 20*b* to pass through it. An adhesive area 92 is provided for attaching the cover 88 to the second sash 16*b*.

While the above description provides examples of one or more processes or apparatuses, other processes or apparatuses may be within the scope of the accompanying claims.

We claim:

1. A combination of a window and a lock comprising, (A) a casement window, the window having a sash with a hole in the sash and a frame with a hole in the frame, wherein the hole in the sash is aligned with the hole in the frame when the window is closed; and, (B) a lock, the lock having (i) a body extending through the hole in the sash and the hole in the frame of the window when the window is closed, the body having a threaded portion;

(ii) a head attached to a first end of the body and bearing against the outside of the sash;

(iii) a nut threaded onto the threaded portion and bearing against the inside of the sash; and, (iv) an abutment attached to a second end of the body, wherein the abutment is capable of being selectively positioned in either of (a) a locked position wherein the abutment is generally perpendicular to the body and bears against the inside of the frame and (b) an unlocked position wherein the abutment is generally aligned with the body and able to pass through the hole in the frame to allow the window to be opened.

2. A window and lock as described in claim 1 further comprising a plug or seal in the hole in the frame, the plug or seal having one or more moveable members biased to cover the hole in the frame when the window is open.

3. A window and lock as described in claim 1 wherein the abutment is mounted for sliding and rotational movement on a pin in a slot of the second end of the body.

4. A window and lock as described in claim 3 wherein the abutment has a slot to receive the pin and the slot is angled relative to a surface of the abutment adapted to bear against the sash.

5. A window and lock as in claim 1 further comprising a spring attached to the body, the spring having an extended position when the abutment is in position (b) in which the spring extends over a portion of the abutment.

6. A combination of a window and a lock comprising, (A) a window, the window having a sash with a hole in the sash and a frame with a hole in the frame, wherein the hole in the sash is aligned with the hole in the frame when the window is closed; and, (B) a lock, the lock having (i) a body extending through the hole in the sash and the hole in the frame of the window when the window is closed;

(ii) a head attached to a first end of the body and bearing against the outside of the sash; and, (iii) an abutment attached to a second end of the body, wherein the abutment is capable of being selectively positioned in either of (a) a locked position wherein the abutment is generally perpendicular to the body and bears against the inside of the frame and (b) an unlocked position wherein the abutment is generally aligned with the body and able to pass through the hole in the frame to allow the window to be opened, wherein the body has a length between the head and the second end of the body that is variable prior to installation of the body in the hole in the sash of the window so as to adapt the distance between the head and the second end of the body to the thickness of the window.

7. A lock for a window, the lock comprising:

(a) a body having a first end, a second end and a threaded portion between the first end and the second end, wherein the first end has a non-circular cross-section and the threaded portion has a circular cross-section;

(b) a head attached to a first end of the body;

(c) a nut threaded onto the threaded portion;

(d) a longitudinal slot in the second end of the body and a pin extending across the slot;

(e) a moveable abutment connected to the second end, and at least partially received in the slot, the abutment having an abutment slot and the pin being slidably and pivotably received in the abutment slot, wherein the abutment is capable of being selectively positioned (i) generally perpendicular to the body and (ii) generally aligned with the body; and (f) a spring, the spring having a first end bearing against the nut and a second end that extends, when the abutment is in position (ii), past the pin and over a portion of the abutment.

8. The lock of claim 7 wherein the body comprises a first part threaded longitudinally into a second part.

* * * * *